US011583989B2

(12) United States Patent
Pugalumperumal

(10) Patent No.: US 11,583,989 B2
(45) Date of Patent: Feb. 21, 2023

(54) MULTI-START THREADED IMPACT DRIVING DEVICE

(71) Applicant: APEX BRANDS, INC., Apex, NC (US)

(72) Inventor: Annamalai Pugalumperumal, Lexington, SC (US)

(73) Assignee: Apex Brands, Inc., Apex, NC (US)

( * ) Notice: Subject to any disclaimer, the term of this patent is extended or adjusted under 35 U.S.C. 154(b) by 296 days.

(21) Appl. No.: 17/102,872

(22) Filed: Nov. 24, 2020

(65) Prior Publication Data

US 2021/0308855 A1 Oct. 7, 2021

Related U.S. Application Data

(60) Provisional application No. 63/004,726, filed on Apr. 3, 2020.

(51) Int. Cl.

| | |
|---|---|
| ***B25D 17/02*** | (2006.01) |
| ***B25B 13/06*** | (2006.01) |
| ***B25B 23/00*** | (2006.01) |
| ***B25B 19/00*** | (2006.01) |

(52) U.S. Cl.

CPC ..... *B25D 17/02* (2013.01); *B25B 13/06* (2013.01); *B25B 19/00* (2013.01); *B25B 23/0035* (2013.01)

(58) Field of Classification Search

CPC ..... B25B 23/0035; B25B 19/00; B25B 13/06; B25D 17/02

See application file for complete search history.

(56) References Cited

U.S. PATENT DOCUMENTS

| | | | |
|---|---|---|---|
| 1,369,491 | A | 2/1921 | Straehle |
| 2,671,484 | A | 3/1954 | Clark |
| 3,630,108 | A | 12/1971 | Stillwagon, Jr. |
| 3,744,350 | A | 7/1973 | Raff |
| 3,779,038 | A | 12/1973 | Stuemky |
| 3,874,194 | A | 4/1975 | Filepp |
| 4,346,630 | A | 8/1982 | Hanson |
| 4,669,339 | A | 6/1987 | Cartwright |
| 5,180,042 | A | 1/1993 | Ogiso |
| 5,839,518 | A | 11/1998 | Setsuko |
| 5,868,047 | A | 2/1999 | Faust et al. |
| D410,372 | S | 6/1999 | Strauch |

(Continued)

FOREIGN PATENT DOCUMENTS

| | | | |
|---|---|---|---|
| CN | 1597263 | A | 3/2005 |
| CN | 1898065 | A | 1/2007 |

(Continued)

OTHER PUBLICATIONS

Office Action from related U.S. Appl. No. 17/368,489 dated Oct. 4, 2021, all pages cited in its entirety.

(Continued)

*Primary Examiner* — David B. Thomas
(74) *Attorney, Agent, or Firm* — Burr & Forman, LLP

(57) ABSTRACT

A torque transfer assembly for an impact bit holder may include a jacket operably coupled to a driven body having a driven end configured to interface with a bit, and a multi-start thread assembly operably coupling the jacket to a drive body having a drive end configured to interface with a powered driver. The torque transfer assembly may be disposed between the drive body and driven body and may be configured to transfer torque between the drive body and the driven body.

20 Claims, 10 Drawing Sheets

(56) References Cited

U.S. PATENT DOCUMENTS

| | | | |
|---|---|---|---|
| 6,105,473 | A | 8/2000 | Huang |
| 6,330,846 | B1 | 12/2001 | Strauch |
| 6,345,560 | B1 | 2/2002 | Strauch |
| 6,640,911 | B2 | 11/2003 | Lieser et al. |
| 6,684,740 | B2 | 2/2004 | Lin |
| 7,096,768 | B1 | 8/2006 | Chen |
| 7,261,023 | B2 | 8/2007 | Taguchi |
| 7,469,909 | B2 | 12/2008 | Strauch |
| 7,597,031 | B2 | 10/2009 | Chiang |
| D623,036 | S | 9/2010 | DeBaker |
| 7,810,817 | B1 | 10/2010 | Gao |
| 8,109,183 | B2 | 2/2012 | Santamarina et al. |
| 8,117,950 | B2 | 2/2012 | Kozak |
| 8,172,236 | B2 | 5/2012 | Shibata |
| 8,226,337 | B2 | 7/2012 | Komine et al. |
| 8,695,461 | B2 | 4/2014 | Moss |
| D711,719 | S | 8/2014 | DeBaker |
| 8,876,120 | B2 | 11/2014 | Chen |
| 8,955,418 | B2 | 2/2015 | Peters et al. |
| 9,095,961 | B1 | 8/2015 | Lenfest |
| 9,107,721 | B2 | 8/2015 | Plotkin |
| D752,408 | S | 3/2016 | Moss et al. |
| 9,283,661 | B2 | 3/2016 | Cummings et al. |
| 9,469,017 | B2 | 10/2016 | Seith et al. |
| 9,649,696 | B2 | 5/2017 | Teusch |
| D789,761 | S | 6/2017 | Moss et al. |
| 9,695,882 | B2 | 7/2017 | Jakoubek |
| 9,764,452 | B2 | 9/2017 | Koch |
| 9,943,946 | B2 | 4/2018 | Peters |
| 10,022,845 | B2 | 7/2018 | Neitzell |
| 10,166,657 | B2 | 1/2019 | Cummings et al. |
| 10,245,645 | B1 | 4/2019 | Hu |
| 10,376,964 | B2 | 8/2019 | Fronius et al. |
| 10,513,017 | B2 | 12/2019 | Lourenco |
| 10,568,391 | B2 | 2/2020 | Glancy et al. |
| 10,991,489 | B2 | 4/2021 | Schneider et al. |
| 11,059,151 | B2 | 7/2021 | Cummings et al. |
| 2006/0009297 | A1 | 1/2006 | Hubiak et al. |
| 2006/0230887 | A1 | 10/2006 | Taguchi |
| 2007/0099712 | A1 | 5/2007 | Smihal |
| 2007/0234856 | A1 | 10/2007 | Liu |
| 2009/0311061 | A1 | 12/2009 | Santamarina et al. |
| 2010/0064860 | A1 | 3/2010 | Kozak |
| 2011/0036212 | A1 | 2/2011 | Santamarina et al. |
| 2011/0170964 | A1 | 7/2011 | Rabate et al. |
| 2016/0038210 | A1 | 2/2016 | Plotkin |
| 2016/0325411 | A1 | 11/2016 | Wang |
| 2019/0232470 | A1 | 8/2019 | Xu |
| 2019/0293041 | A1 | 9/2019 | Dong et al. |
| 2020/0215675 | A1 | 7/2020 | Hawkins |
| 2021/0331302 | A1 | 10/2021 | Fairchild et al. |

FOREIGN PATENT DOCUMENTS

| | | | |
|---|---|---|---|
| CN | 102470516 | A | 5/2012 |
| CN | 102744700 | A | 10/2012 |
| CN | 104786184 | A | 7/2015 |
| CN | 2018147717 | U | 11/2018 |
| EP | 2098336 | A3 | 10/2011 |
| WO | 2012049078 | A1 | 4/2012 |
| WO | 2018204468 | A1 | 11/2018 |
| WO | 2020005805 | A1 | 1/2020 |

OTHER PUBLICATIONS

Search Report from related International Application No. PCT/US2021/049374 dated Sep. 24, 2021, all pages cited in its entirety.
International Search Report Written Opinion from International Application No. PCT/US2021/049371 dated Dec. 21, 2021, all pages cited in its entirety.

FIG. 1A
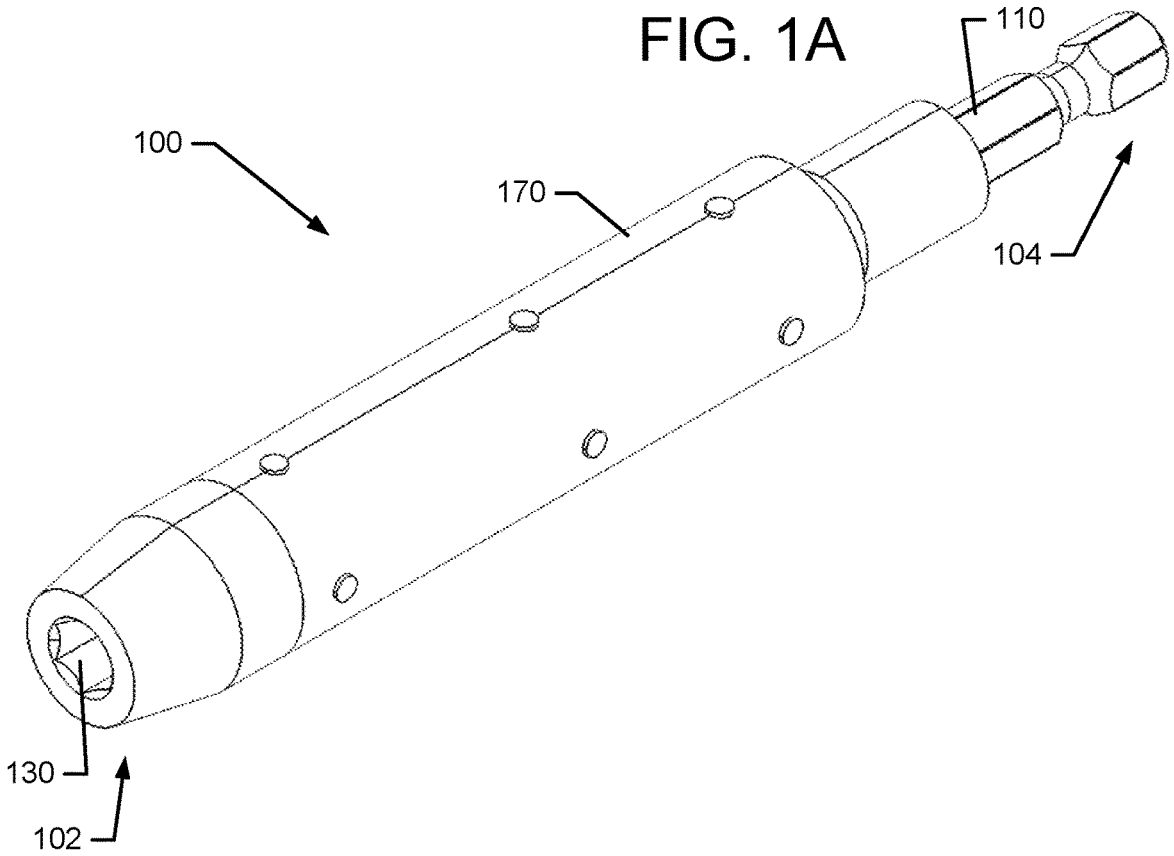
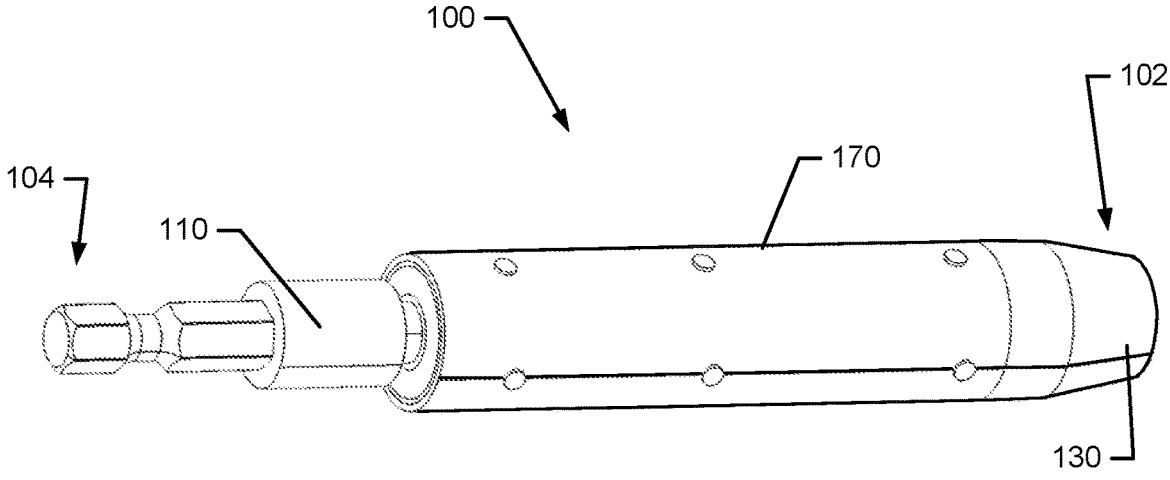
FIG. 1B

FIG. 2A
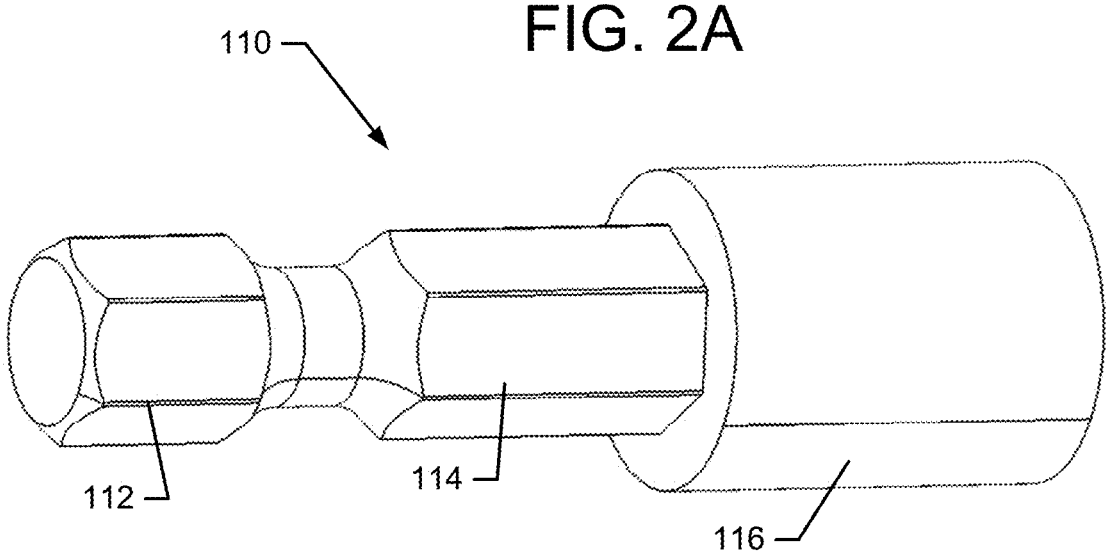
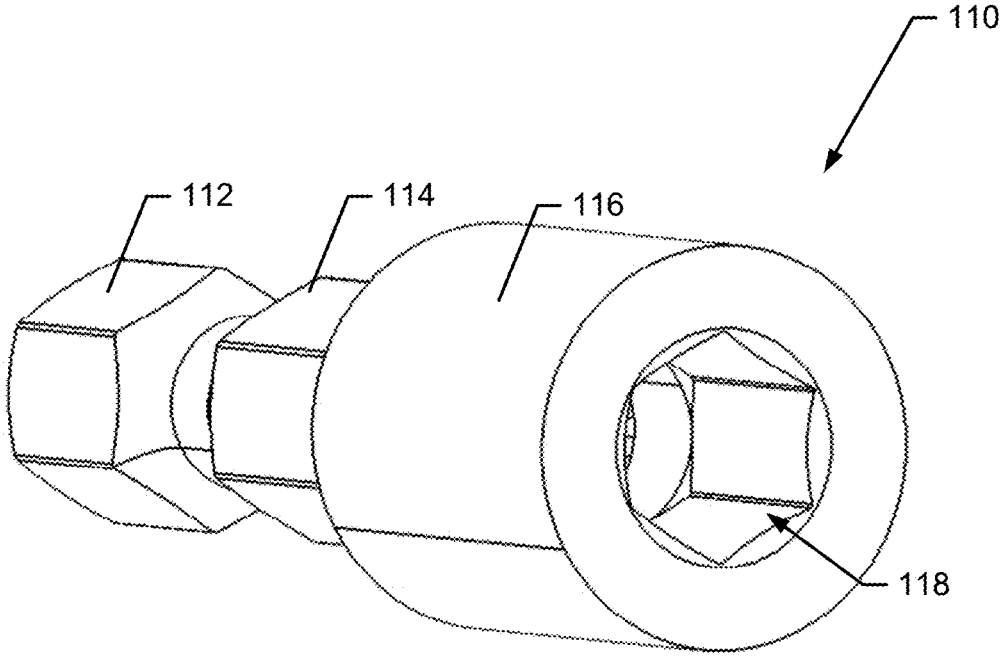
FIG. 2B

FIG. 3A
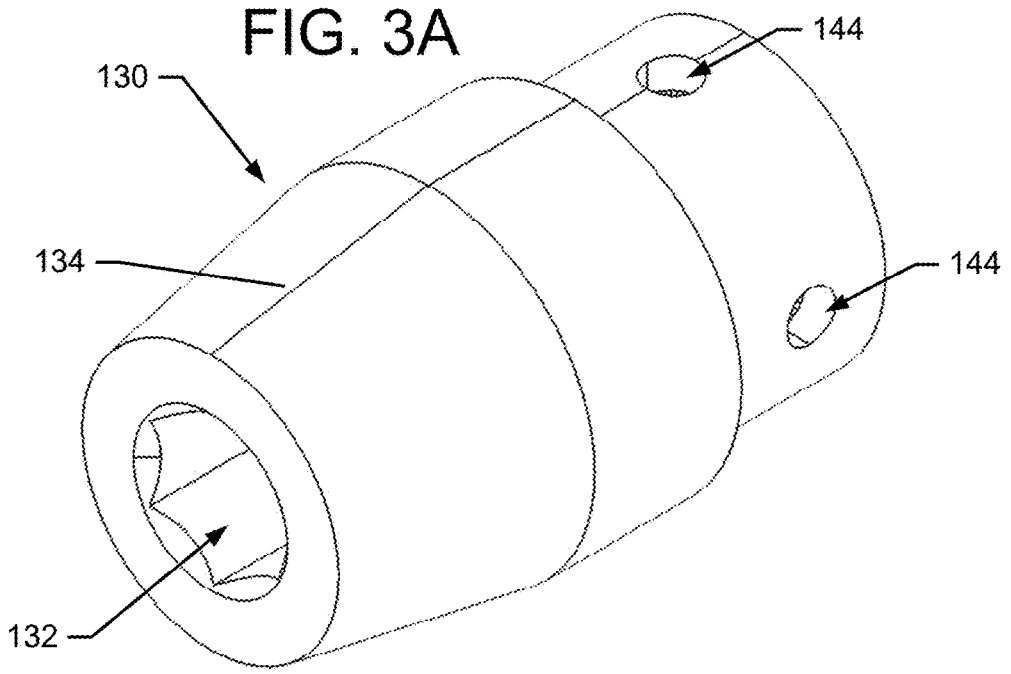
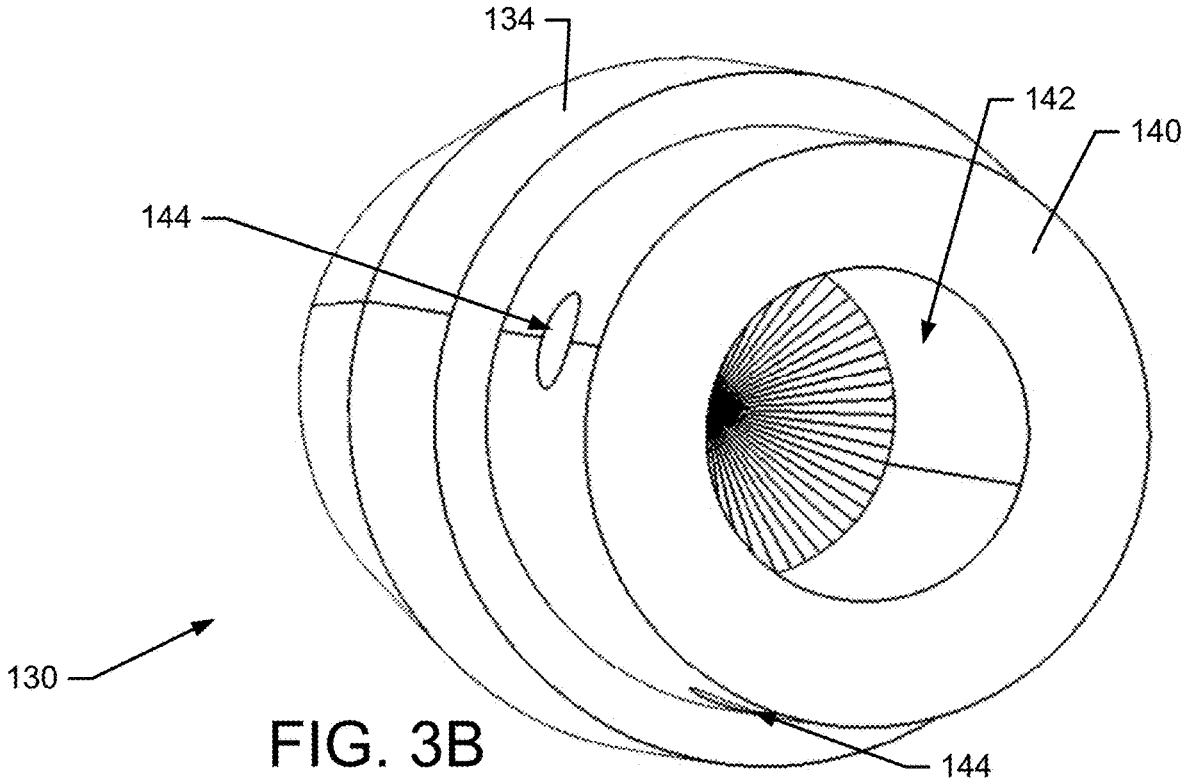
FIG. 3B

FIG. 5B
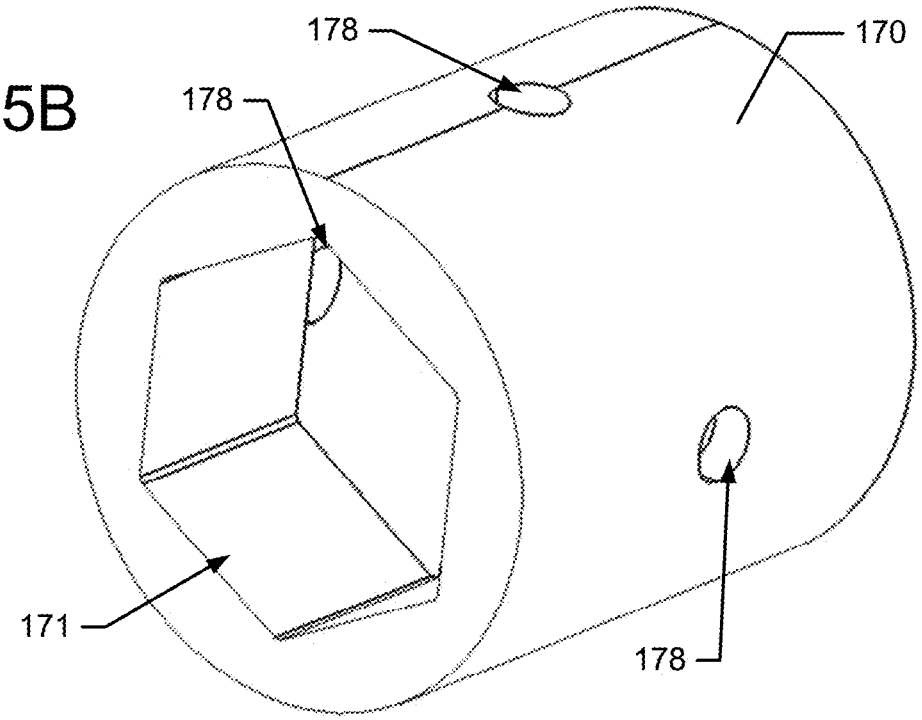
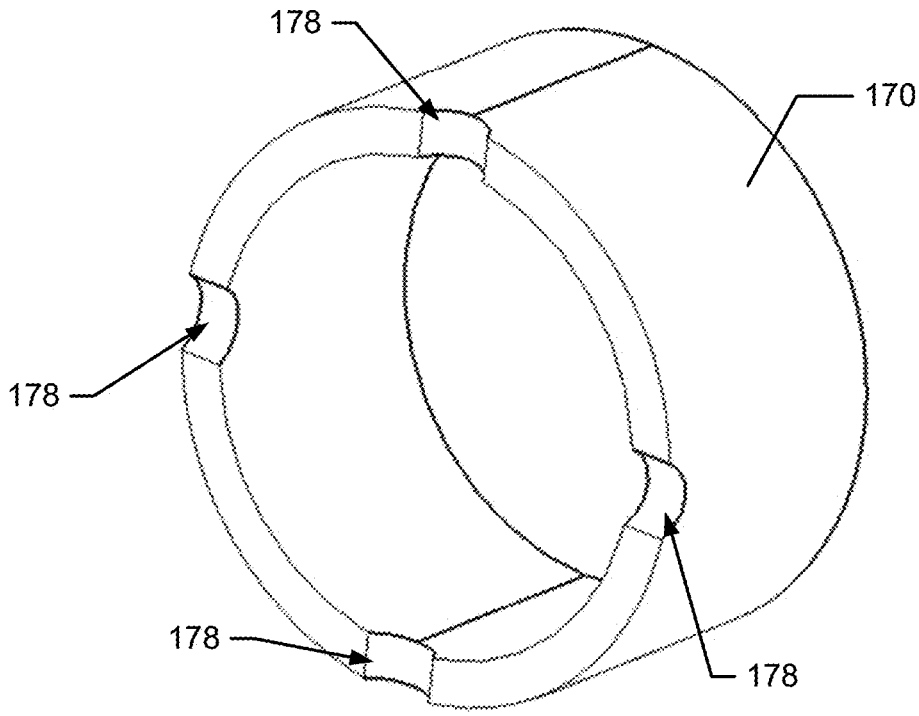
FIG. 5C

FIG. 6A
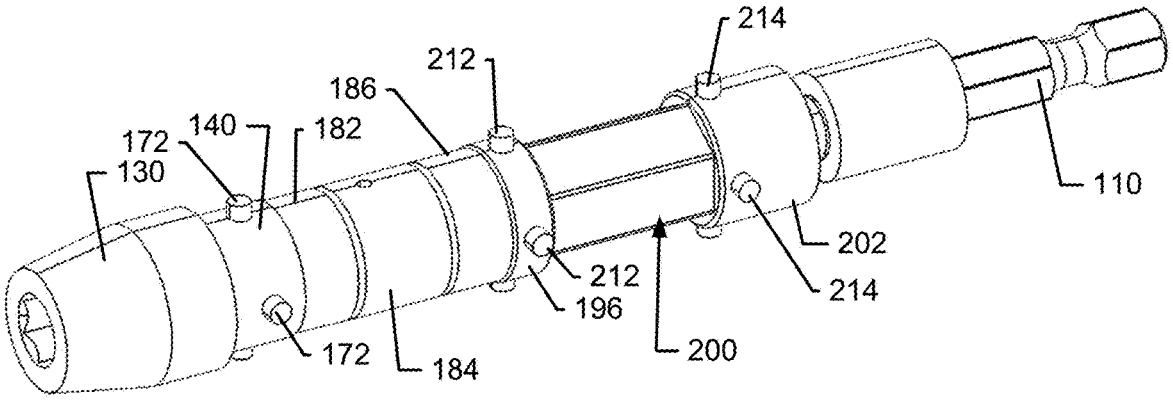
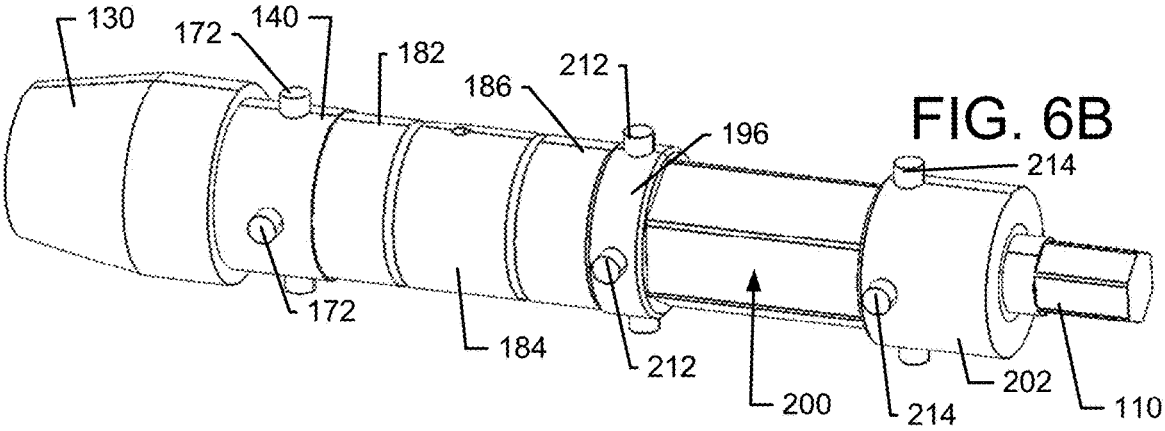
FIG. 6B
FIG. 6C
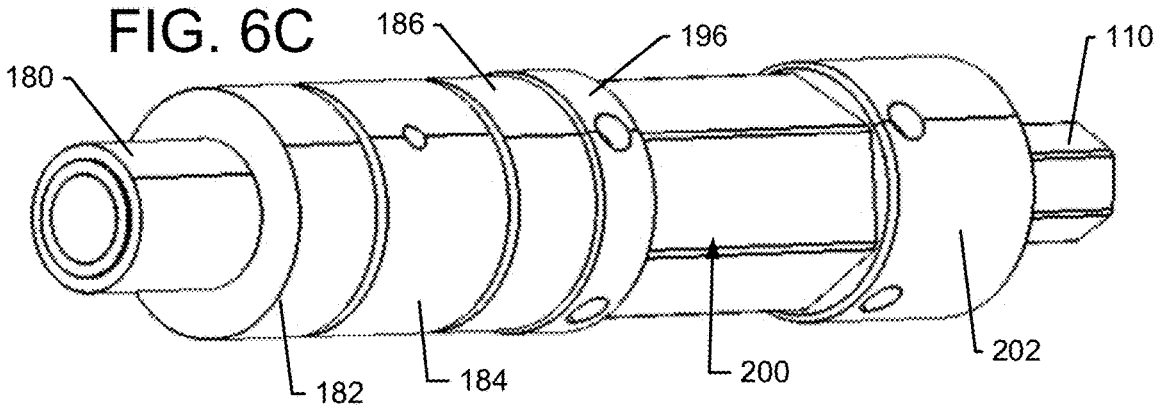

FIG. 7A
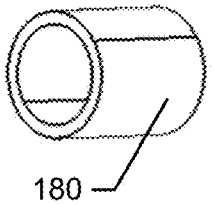
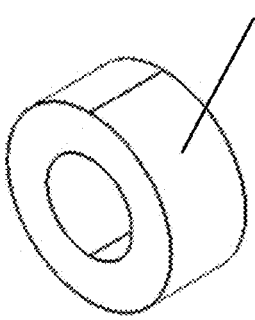
FIG. 7B
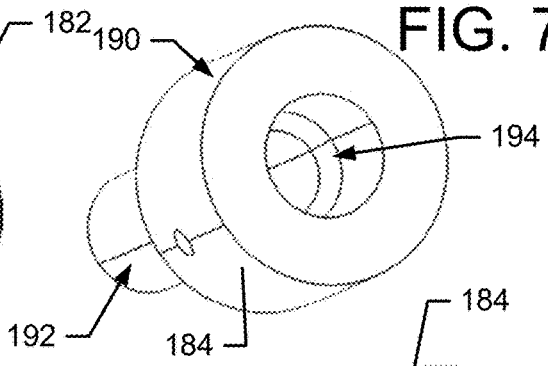
FIG. 7C
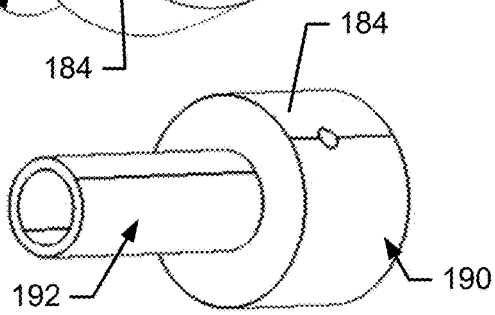
FIG. 7D
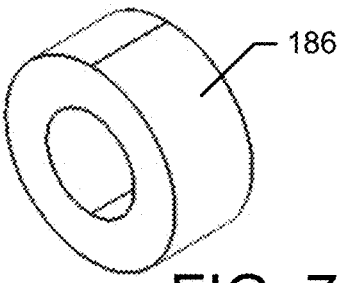
FIG. 7E
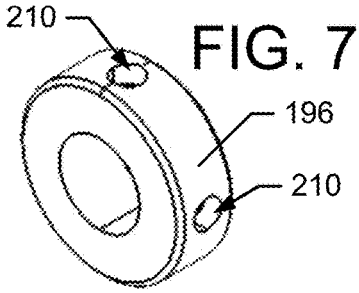
FIG. 7F
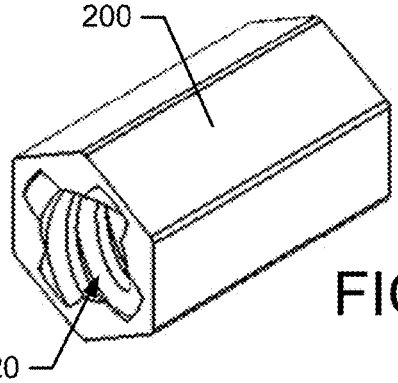
FIG. 7G
FIG. 7H
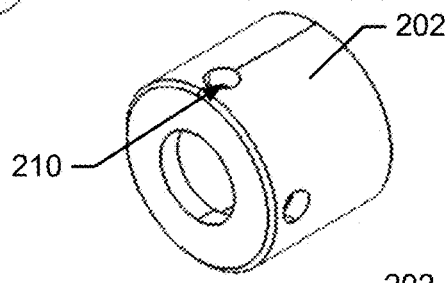
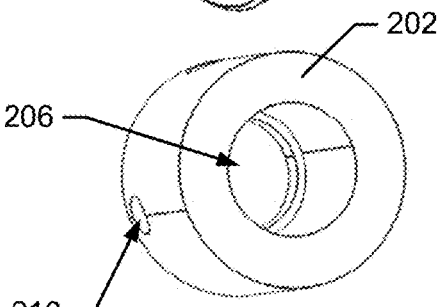
FIG. 7I
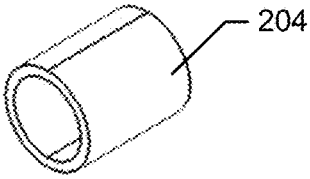
FIG. 7J FIG. 8A
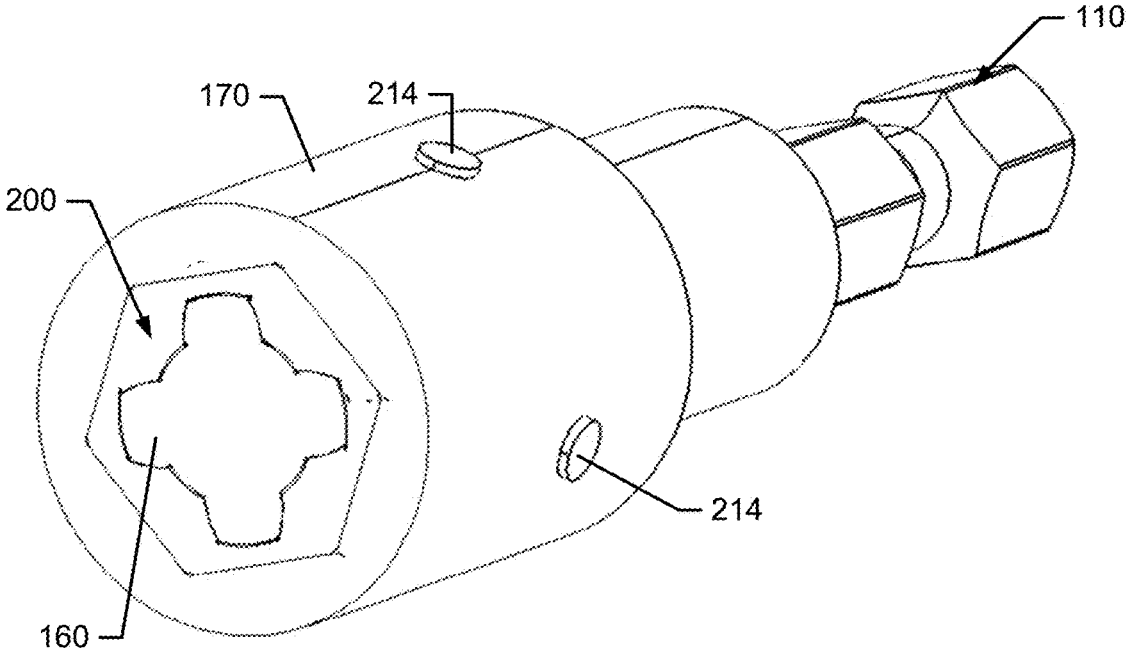
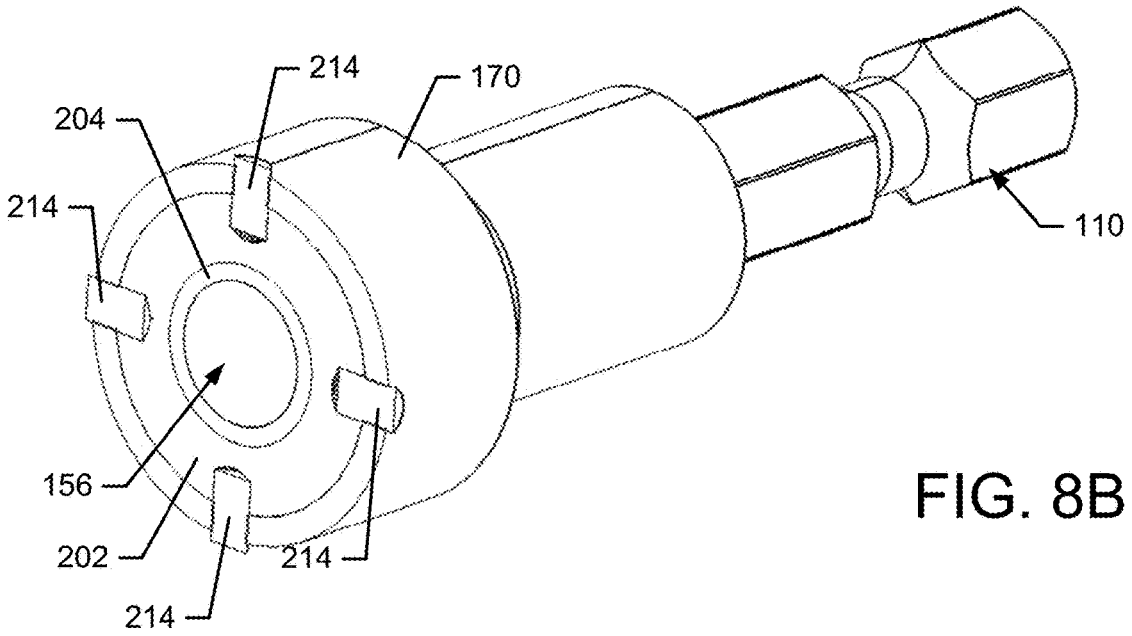
FIG. 8B

MULTI-START THREADED IMPACT DRIVING DEVICE

CROSS-REFERENCE TO RELATED APPLICATIONS

This application claims priority under 35 U.S.C. § 119(e) to U.S. Provisional Application No. 63/004,726, filed Apr. 3, 2020, which is expressly incorporated by reference herein in its entirety.

TECHNICAL FIELD

Example embodiments generally relate to driving devices such as socket tools, bit holders and other fastener driving components. In particular, example embodiments relate to impact drivers, and provide a form of overload protection for impact drivers.

BACKGROUND

Driving devices, such as socket tools and bit holders, are familiar tools for fastening nuts and driving other drivable components or fasteners. Bit holders, for example, often have a drive end that includes a conventional interface for receiving drive energy from a powered driving device. The drive end may have a standard sized hex head or another conventional power bit drive end geometry. The bit holder may also include a driven end, which is driven by the rotational force applied by the powered driving device at the drive end, and which in turn applies drive energy to a bit. The bit may be received in a hex shaped socket, or any other bit holding geometry that defines a receptacle for the bit.

Bits of various sizes and shapes may have standard (e.g., hex) heads that enable any of the various different bits to interchangeably be inserted into the bit holder. Thus, by attaching the bit holder to the powered driving device (e.g., via a chuck of the powered driving device), any number of different bits can quickly and easily be substituted to meet each situation that is encountered. Because high torque is often applied through these tools, and high strength and durability is desirable, the bit holders are traditionally made of a metallic material such as iron or steel.

Impact drivers are typically employed to apply high and sudden torque to fasteners. The high and sudden torque application made possible by these devices may be particularly useful for loosening of frozen or over-torqued fasteners. However, the application of high and sudden torque may also be useful for applying a high torque to a fastening device that is being used in a context that requires a high input torque. In either case, if a bit holder is used with an impact driver, and the bit holder is rigidly made of metallic materials, the suddenness of the application of force by the powered driving device is equally suddenly applied through the bit holder and to the bit, which could damage the bit, the fastener, or even the bit holder. Thus, it may be desirable to improve bit holder design to lengthen the useful life of driver bits and bit holders.

BRIEF SUMMARY OF SOME EXAMPLES

Some example embodiments may enable the provision of a bit driver that includes a driven end and drive end that are operably coupled to each other via a torque transfer mechanism that, although still applying full impact energy, ensures that loads through the bit holder (and the bit) are alleviated or lessened. Thus, high hardness driver bit life can be considerably lengthened.

In an example embodiment, a torque transfer assembly for an impact bit holder is provided. The torque transfer assembly may include a jacket operably coupled to a driven body having a driven end configured to interface with a bit, and a multi-start thread assembly operably coupling the jacket to a drive body having a drive end configured to interface with a powered driver. The torque transfer assembly may be disposed between the drive body and driven body and may be configured to transfer torque between the drive body and the driven body.

In another example embodiment, an impact bit holder may be provided. The impact bit holder may include a drive body having a drive end configured to interface with a powered driver, a driven body having a driven end configured to interface with a bit, and a torque transfer assembly. The torque transfer assembly may be disposed between the drive body and driven body and configured to transfer torque between the drive body and the driven body. The torque transfer assembly may include a jacket operably coupled to the driven body, and a multi-start thread assembly operably coupling the jacket to the drive body.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

FIG. 1A illustrates a perspective view of a driven end of a bit holder according to an example embodiment;

FIG. 1B is a perspective view of a drive end of the bit holder according to an example embodiment;

FIG. 2A is a perspective view of a drive end of a drive body in isolation according to an example embodiment;

FIG. 2B is a perspective view of the opposite end of the drive body in isolation according to an example embodiment;

FIG. 3A is a perspective view of a driven end of a driven body in isolation according to an example embodiment;

FIG. 3B is a perspective view of the opposite end of the driven body in isolation according to an example embodiment;

FIG. 5B is a perspective cross section view of the jacket taken along line A-A' on FIG. 1C according to an example embodiment;

FIG. 5C is a perspective cross section view of the jacket taken along line B-B' on FIG. 1C according to an example embodiment;

FIG. 6A is a perspective view of the bit holder with the jacket removed according to an example embodiment;

FIG. 6B is another perspective view of the bit holder with the jacket removed according to an example embodiment;

FIG. 6C is a perspective view of the bit holder with the jacket and both the drive body and driven body removed according to an example embodiment;

FIG. 7A illustrates a perspective view of a first bushing in isolation according to an example embodiment;

FIG. 7B is a perspective view of a first impact energy absorbing washer according to an example embodiment;

FIG. 7C is a rear perspective view of a hammer head in isolation according to an example embodiment;

FIG. 7D is a front perspective view of a hammer head in isolation according to an example embodiment;

FIG. 7E is a perspective view of a second impact energy absorbing washer according to an example embodiment;

FIG. 7F is a perspective view of a first plug in isolation according to an example embodiment;

FIG. 7G is a perspective view of a threaded nut in isolation according to an example embodiment;

FIG. 7H is a front perspective view of a second plug in isolation according to an example embodiment;

FIG. 7I is a rear perspective view of the second plug in isolation according to an example embodiment;

FIG. 7J is a perspective view of a second bushing in isolation according to an example embodiment;

FIG. 8A is a cross section view of the bit holder taken along line A-A' in FIG. 1C according to an example embodiment; and FIG. 8B illustrates a cross section view of the bit holder taking along line B-B' in FIG. 1C according to an example embodiment.

DETAILED DESCRIPTION

Figure 1C:
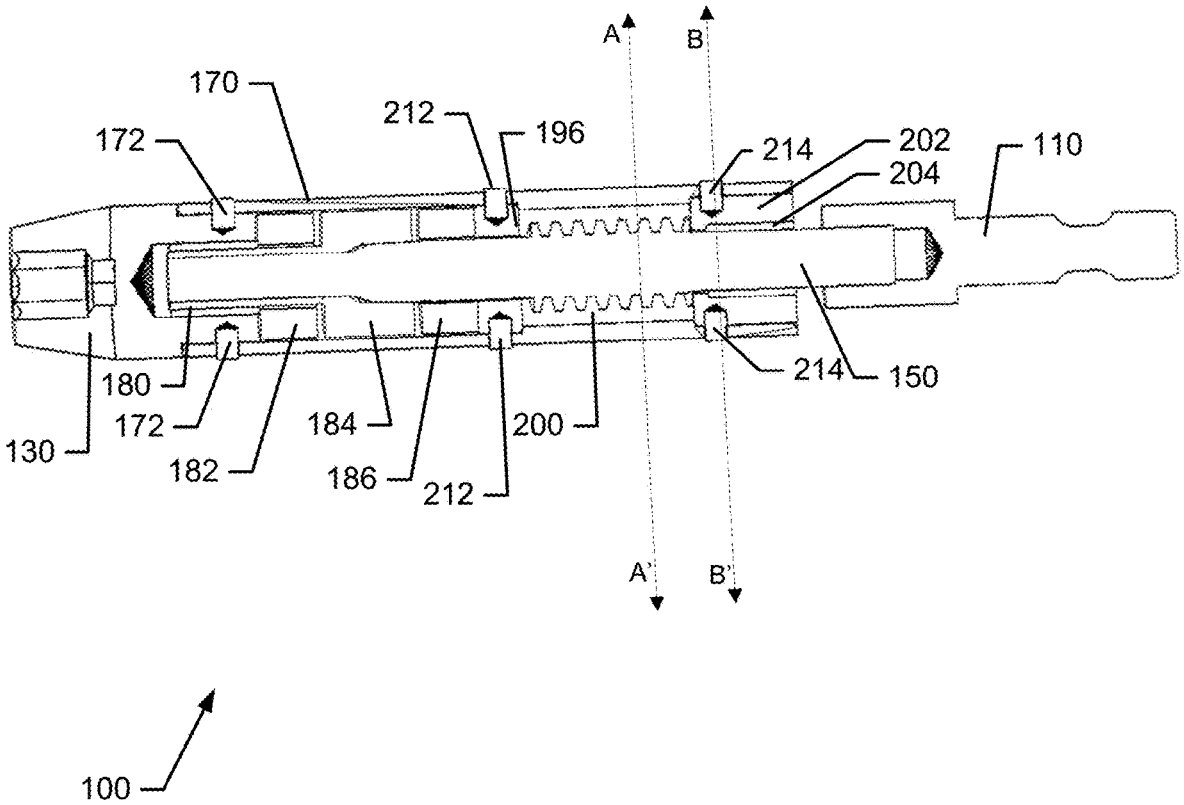
FIG. 1C is a cross section view of the bit holder taken along a longitudinal axis thereof in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of driving tool such as a bit holder that can be used with impact drivers. In an example embodiment, the driving tool (which will be described as a bit holder to illustrate one example) may be constructed in such a way as to prevent the bit holder from absorbing and dissipating all of the torque load applied thereto within the metal shaft or core of such device. Instead, a structure is employed that strategically distributes forces within the device without reducing the overall impact energy that can be delivered through the device. For example, the bit holder described herein may include a drive end and a driven end that are coupled together via a torque transfer assembly that employs a multi-start threaded core component configured to facilitate more elasticity in relation to torque transfer. Some structures that can employ example embodiments will now be described below by way of example and not limitation.

FIG. 1A illustrates a perspective view of a bit holder 100 according to an example embodiment, showing a driven end 102 thereof. FIG. 1B is a perspective view of the bit holder 100 showing the drive end 104 thereof. FIG. 1C is a cross section view through the longitudinal axis of the bit holder 100. As noted above, the drive end 104 is configured to interface with a powered driving device and the driven end 102 is configured to interface with a bit. The drive end 104 may include a drive body 110 shown in isolation in FIG. 2, which is defined by FIGS. 2A and 2B. The drive body 110 may include a hex head 112 and shaft 114 that are coaxial with each other and a base portion 116. The base portion 116 may be a cylindrical body that defines a transition to a torque transfer assembly of the bit holder 100. The base portion 116 may include a reception cavity 118 at an end thereof that is opposite the hex head 112. The reception cavity 118 may also have a hex shape to facilitate connection to the torque transfer assembly of the bit holder 100.

The driven end 102 may include the driven body 130, as noted above. The drive end 102 may be configured to interface with the bit in order to drive the bit responsive to the application of torque by the powered driving device to the drive end 104. The driven body 130 is shown in isolation in FIG. 3, which is defined by FIGS. 3A and 3B, showing perspective views of the driven body 130 from a front end (i.e., the end that interfaces with the bit—FIG. 3A) and rear end (i.e., the end that interfaces with the torque transfer assembly and remainder of the bit holder 100—FIG. 3B). In this regard, the driven body 130 may include a hex socket 132 and socket body 134 that are coaxial with each other and a coupling member 140. The coupling member 140 may be embodied as hollow cylindrical body that extends rearward from the socket body 134 (i.e., away from the front end). The coupling member 140 may also include a core member receiver 142, which may be an orifice configured to interface with and receive a core member 150 shown in isolation in FIG. 4. In this case the core member receiver 142 may define a round opening that is substantially similar in inside diameter to the outside diameter of the front end 152 of the core member 150. The coupling member 140 may also include one or more (in this case four) radial pin receivers 144 formed therein. The radial pin receivers 144 may be orifices that pass partially or entirely through a portion of the coupling member 140 in a radial direction. In the example shown in FIG. 3, the radial pin receivers 144 may extend partially through the coupling member 140 in an inward direction from an outer peripheral surface of the coupling member 140. The radial pin receivers 144 may be spaced equidistantly apart from each other about the periphery of the coupling member 140. As such, the coupling member 140 and structural features thereof (e.g., the radial pin receivers 144 and the core member receiver 142) may define structures configured to provide a transition to a torque transfer assembly from the driven body 130.

Figure 4:
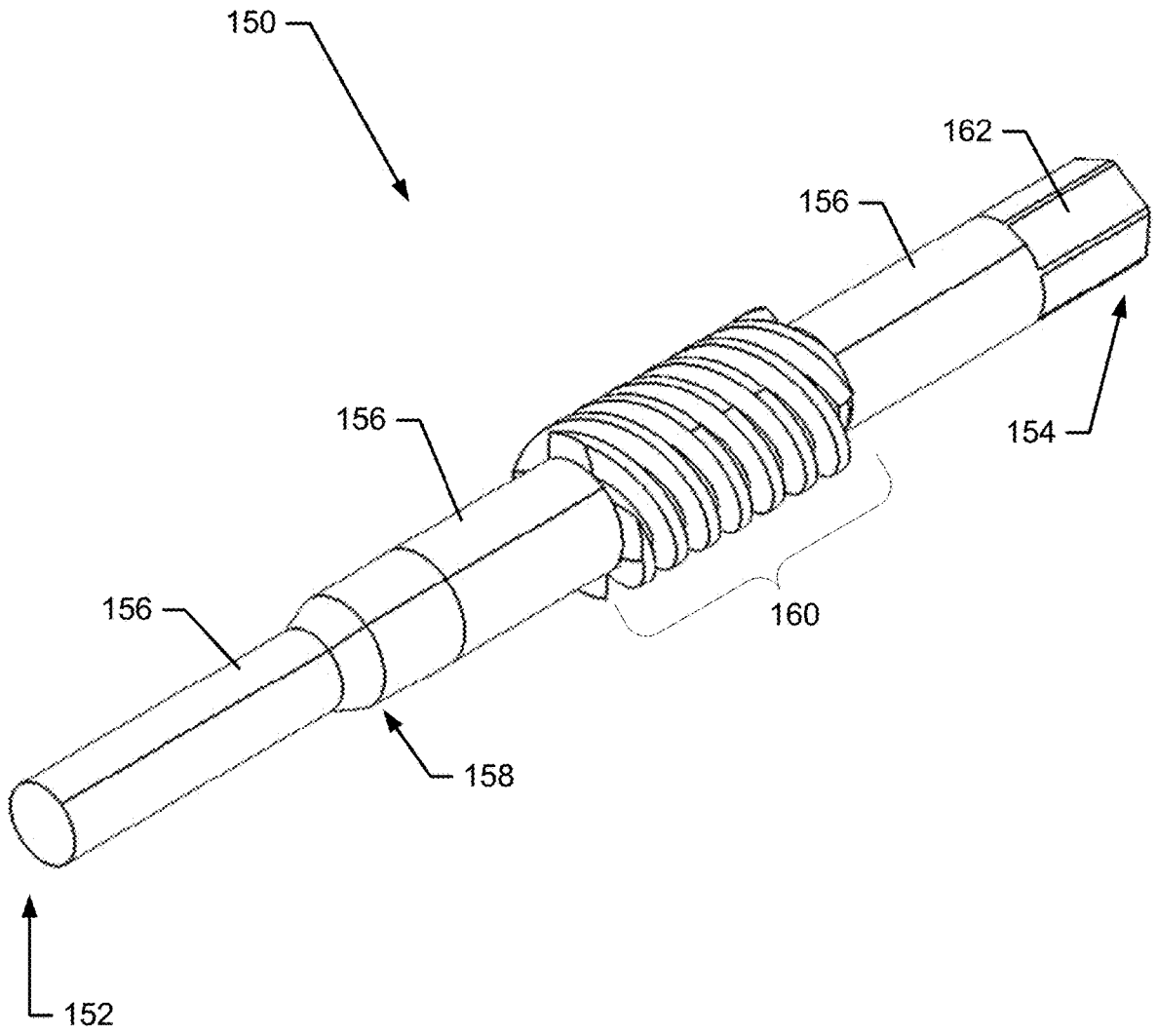
FIG. 4 is a perspective view of a core member in isolation according to an example embodiment.

Referring now to FIG. 4, the core member 150 comprises the front end 152 and a rear end 154. The core member 150 may be a single unitary metallic component (e.g., in the form of a cylindrical rod 156) that extends from the front end 152 to the rear end 154. The rod 156 may extend rearward from the front end 152 to the rear end 154 with a consistent diameter (D1) from the front end 152 until a transition region 158 is reached. At the transition region 158, the diameter of the rod 156 may increase to a second and slightly larger diameter (D2). The rod 156 may continue to extend rearward having a consistent (and larger relative to portion of the rod 156 closest to the front end 152) diameter until a threaded portion 160 is reached. The threaded portion 160 of the core member 150 may include a multi-start thread. The multi-start thread, by definition, includes two or more intertwined threads running parallel to one another. The multi-start thread employs the intertwined threads in order to enable the lead distance of the threads to be increased without changing pitch. Thus, for example, a double start thread may have a lead distance that is double that of a single start thread of the same pitch, while a triple start thread may have a lead distance that is three times longer than a single start thread of the same pitch. By maintaining a constant pitch, multi-start threads can maintain a shallow thread depth relative to a longer lead distance and may provide more contact surface to engaged in a single thread rotation. A relatively short lateral movement along the axis of the threaded portion 160 may therefore result in a relatively large contact surface area.

After the threaded portion 160, the rod 156 of the core member 150 may continue to extend rearward (e.g., having a same diameter as the portion of the rod 156 immediately forward of the threaded portion 160) until drive body interface 162 is reached. The drive body interface 162 may include a hex shaped protrusion that is configured to friction fit with the reception cavity 118 of the drive body 110. Thus, although the drive body 110 and the core member 150 are affixed to each other via the friction fit of the drive body interface 162 and the reception cavity 118, there is no direct coupling between the front end 152 of the cylindrical rod 156 and the driven body 130. Thus, the driven body 130 and the core member 150 are not directly connected to each other. Instead, the driven body 130 and the core member 150 are indirectly coupled to each other via the torque transfer assembly.

Figure 5A:
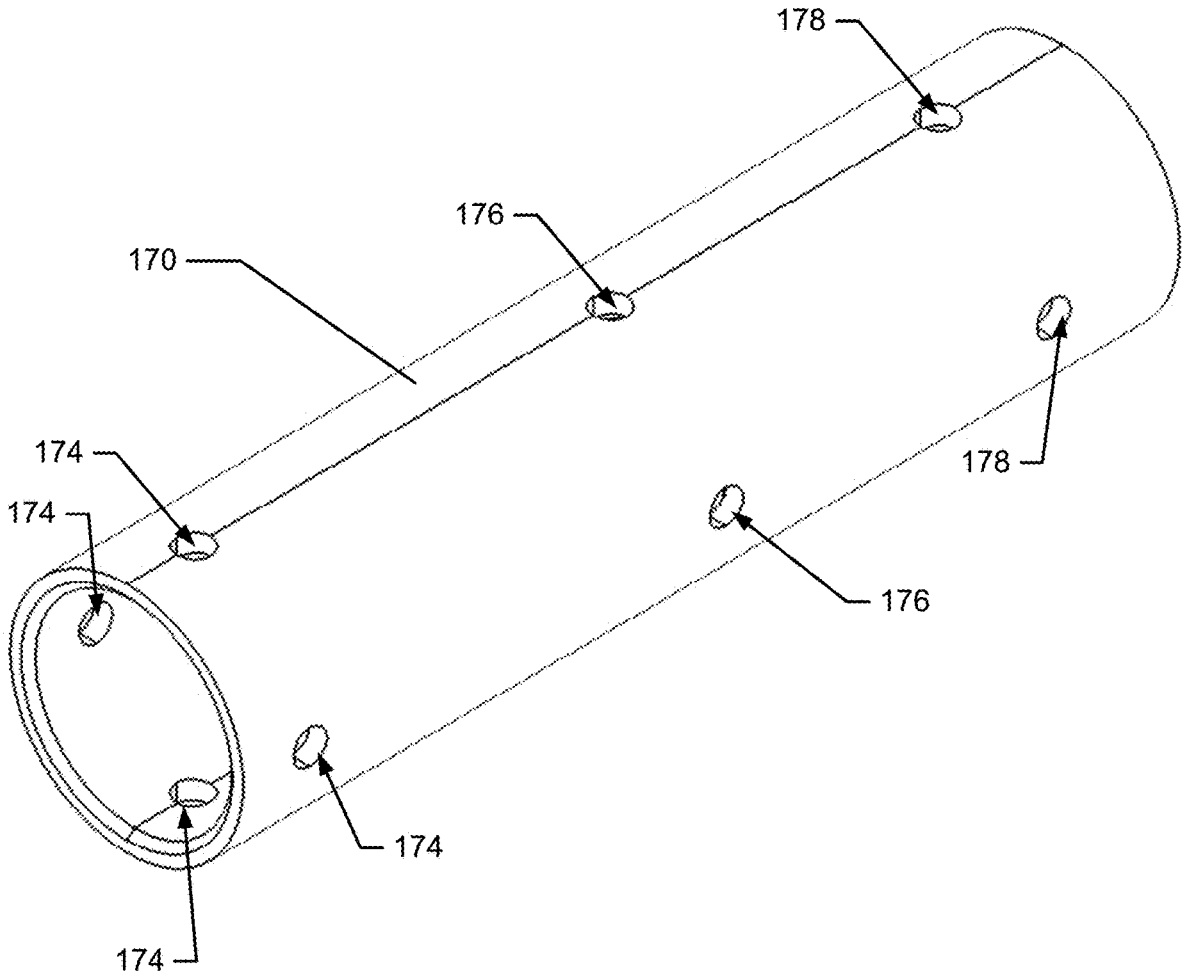
FIG. 5A is a perspective view of a jacket in isolation according to an example embodiment.

The torque transfer assembly includes a jacket 170 that interfaces directly with the driven body 130 via a first set of radial pins 172, and interfaces indirectly with the core member 150 via a plurality of internal assembly components (so called since they are all located inside the jacket 170). The jacket 170 is shown in isolation in FIG. 5A, and has a cylindrical shape on its outside surface. Cross section views of the jacket (in isolation) are also taken along lines A-A' and B-B' (from FIG. 1C), which are shown in FIGS. 5B and 5C, respectively. The jacket 170 is also formed as a hollow cylinder, with a circular internal diameter at portions thereof that correlate to the portions of the core member 150 other than those that are disposed axially aligned with the threaded portion 160 (as shown in FIG. 5C). A nut engaging portion 171 of the jacket 170, which corresponds to the threaded portion 160, has a hex shaped cross section (as shown in FIG. 5B).

In an example embodiment, the jacket 170 may include a first set of radial pin orifices 174 that are configured to receive the first set of radial pins 172. The jacket 170 may also include a second set of radial pin orifices 176 and a third set of radial pin orifices 178. Each of the first, second and third sets of radial pin orifices 174, 176 and 178 may (in this example) be a group for four radial pin orifices that are equidistantly spaced apart from the other pin orifices of the same set. In other words, all four of the pin orifices of the first set of pin orifices 174 are disposed at positions offset from each other by about 90 degrees proceeding around the periphery of the jacket 170. The first set of radial pin orifices 174 are also all located a same axial distance from an end of a first longitudinal end of the jacket 170. The second set of radial pin orifices 176 are equally spaced apart from the first set of radial pin orifices 174 and otherwise radially aligned with corresponding ones of the first set of radial pin orifices 174. Similarly, the third set of radial pin orifices 178 are equally spaced apart from the second set of radial pin orifices 176 and otherwise radially aligned with corresponding ones of the first and second sets of radial pin orifices 174 and 176.

The first set of radial pin orifices 174 may align with the radial pin receivers 144 formed in the coupling member 140 of the driven body 130 such that the first set of radial pins 172 may be passed through respective ones of the first set of radial pin orifices 174 and the radial pin receivers 144 in order to operably couple the jacket 170 to the driven body 130 (i.e., directly). Any axial movement of the jacket 170 will therefore cause corresponding axial movement of the driven body 130 (or vice versa). Meanwhile, the second and third sets of radial pin orifices 176 and 178 may be aligned with radial pin receivers formed in corresponding other components of the torque transfer assembly.

FIGS. 6A and 6B illustrates perspective views of the bit holder 100 with the jacket 170 removed to illustrate the internal assembly components of the torque transfer assembly. FIG. 6C is a perspective view of the internal assembly components of the torque transfer assembly mounted on the core member 150. Meanwhile, FIGS. 7A, 7B, 7C, 7D, 7E, 7F, 7G, 7H, 7I and 7J show individual components among the internal assembly components in isolation.

Referring to FIGS. 6A, 6B and 7A-7J, the internal assembly components of the torque transfer assembly may include a first bushing 180 (shown in isolation in FIG. 7A), a first energy absorbing washer 182 (shown in isolation in FIG. 7B), a hammer head 184 (shown in isolation with respective front and rear perspective views in FIGS. 7C and 7D), and a second energy absorbing washer 186 (shown in isolation in FIG. 7E. As shown in FIGS. 6A, 6B and 6C, the first bushing and the first energy absorbing washer 182 may overlap each other and a portion of the hammer head 184. The second energy absorbing washer 186 may be placed on an opposite side of the hammer head 184 relative to the first energy absorbing washer 182.

The hammer head 184 may be formed by a single unitary component (e.g., a plastic having a high compressive strength such as Radel® polyphenylsulfone (PPSU)) that includes a main body 190, and an extension portion 192. The extension portion 192 and the main body 190 may each be hollow cylindrical bodies with the extension portion 192 extending coaxially from one axial end of the main body 190. An external diameter of the main body 190 may be substantially larger than an external diameter of the extension portion 192. In some cases, the external diameter of the extension portion 192 may be approximately equal to the diameter (D2) of the rod 156 between the transition region 158 and the threaded portion 160.

An internal diameter of the extension portion 192 may be smaller than an internal diameter of the main body 190. In this regard, for example, the internal diameter of the extension portion 192 may be about equal to the diameter (D1) of the rod 156 between the transition region 158 and the front end 152. The internal diameter of the main body 190 may be approximately equal to the diameter (D2) of the rod 156 between the transition region 158 and the threaded portion 160. A transition 194 may be disposed at an intersection of the main body 190 and the extension portion 192 at internal portions thereof to accommodate the change in diameters. The transition 194 may correspond to the transition region 158 of the rod 156. To the extent the rod 156 moves axially toward the driven member 130, the hammer head 184 may exert a force linearly along the axis of the bit holder 100 in a direction toward the driven member 130 via the transition region 158 contacting the transition 194

The first bushing 180 may be a hollow cylindrical bushing made of plastic and configured to absorb radial loads between the rod 156 proximate to the front end 152 thereof and the coupling member 140. The first bushing 180 may have an internal diameter slightly larger than the diameter (D2) so that the first bushing 180 is able to slide over the distal end of the extension portion 192 to fit between the extension portion 192 and the inside of the coupling member 140 (i.e., inside the core member receiver 142). One end of the first bushing 180 may or at least be disposed proximate to the first energy absorbing washer 182. An internal diameter of the first energy absorbing washer 182 may therefore also be understood to be about equal to (D2) so that the first energy absorbing washer 182 can slide over the extension portion 182 to be proximate to the main body 190 and between the main body 190 and the coupling member 140 and first bushing 180. The first energy absorbing washer 182 may also be made of PPSU in some cases, or some other plastic with a high compressive strength.

The second energy absorbing washer 186 may be disposed along the rod 156 opposite the main body 190 of the hammer head 184 relative to the first energy absorbing washer 182. In some cases, a small gap may be provided between the first energy absorbing washer 182 and the axial face of the hammer head 184 that faces the first energy absorbing washer 182, and another small gap may be provided between the second energy absorbing washer 186 and the axial face of the hammer head 184 that faces the second energy absorbing washer 186. However, these gaps may be reduced (even to zero) when the hammer head 184 is displaced due to movement of the rod 156 and/or movement of the threaded portion 160 along the axis of the bit holder 100. An internal diameter of the second energy absorbing washer 186 may also be understood to be about equal to (D2) so that the second energy absorbing washer 186 can slide over the rod 156 at a portion thereof between the transition region 158 and the threaded portion 160. The second energy absorbing washer 186 may also be made of PPSU in some cases, or some other plastic with a high compressive strength. In any case, the first and second energy absorbing washers 182 and 186 may be made of material selected based on the compressive strength of the material taking into account the axial area of contact with adjacent components. The material selected should not go into a permanent deformation zone when the bit holder 100 is in operation. The softness of the first and second energy absorbing washers 182 and 186, surface load stress and temperature are also considerations for material selection.

The internal assembly components of the torque transfer assembly may also include a first plug 196, a threaded nut 200, a second plug 202 and a second bushing 204. The second bushing 204 may be similar (and in some cases identical) to the first bushing 180 in size and shape. The threaded nut 200 may be disposed between the first plug 196 and the second plug 202, and may be made of bronze or a similar metallic material. Meanwhile, the second plug 202 may include a bushing cavity 206 disposed at an internal portion thereof to enable the second bushing 204 to be retained therein between the second plug 202 and the rod 156 to absorb radial loads. The bushing cavity 206 may open rearward (i.e., in a direction opposite an axial face of the second plug 202 that faces the threaded nut 204) in order to receive the second bushing 204 between the second plug 202 and the portion of the rod 156 located between the threaded portion 160 and the drive body interface 162.

As shown in FIGS. 7F, 7I and 7H, the first and second plugs 196 and 202 may each include pin receivers 210 disposed to correspond to the second and third sets of radial pin orifices 176 and 178, respectively. A second set of radial pins 212 may extend through the pin receivers 210 of the first plug 196 and the second set of radial pin orifices 176. A third set of radial pins 214 may extend through the pin receivers 210 of the second plug 202 and the third set of radial pin orifices 178. Accordingly, the driven body 130, the jacket 170 and each of the first and second plugs 196 and 202 may be directly coupled to rotate axially with each other. Moreover, by virtue of the outer hex shape of the threaded nut 200, and the engagement of the outer hex shape of the threaded nut 200 with the nut engaging portion 171 of the jacket 170, any rotational movement of the jacket 170 is also communicated to the threaded nut 200 (or vice versa). Meanwhile, threads 220 of the threaded nut 200 engage with the multi-start threads of the threaded portion 160.

The engagement between the threaded nut 200 and the threads 220 is visible in the cross section view shown in FIG. 8A (taken along line A-A' from FIG. 1C). The engagement of the outer hex shape of the threaded nut 200 with the nut engaging portion 171 of the jacket 170 is also shown in FIG. 8A. Meanwhile, FIG. 8B, which is a cross section taken along line B-B' of FIG. 1C, shows the engagement between the jacket 170 and the second plug 202.

Accordingly, based on the structures described above (and particularly based on the torque transfer assembly and the coupling the torque transfer assembly provides between the drive end 110 and the driven end 130, rotary impact energy, which is short in duration due to operation of an impact driver, may be absorbed. In this regard, an energy absorbing plastic or spring can dissipate the destructive energy that might otherwise be absorbed by a unitary bit holder made of metal, or including plastics disposed between two metallic bodies. In this example, rotary motion is converted to linear motion by the interface between the threaded nut 200 and the jacket 170 (i.e., the nut engaging portion 171 thereof) acting as a power screw. The power screw may have a small helix angle (due to the interaction of the multi-start threads with the threads 220 of the threaded nut 200) that can maintain tightness between the bodies. In this regard, the threads of a multi-start thread and nut will never stay tight, and the nut will always come loose at the end of a peak impact energy transmission.

Accordingly, when the core member 150 rotates, the threaded nut 200 will initially be kept stationary because of the engagement with the screw head (engaged with the driven member 130). The multi-start threads of the threaded portion 160 and the interface with the threads 220 of the threaded nut 200 may cause a linear motion for the threaded nut 200 (or jacket 170) when the threaded portion 160 of the core member 150 turns (responsive to power application from a driving device). The movement of the threaded nut 200 may exert a linear force on the core member 150 (through the interaction of the threads) to drive the hammer head 184 toward the driven member 130 reducing the gap between the hammer head 184 and the first energy absorbing washer 182. When the hammer head 184 hits the first energy absorbing washer 182, the threaded nut 200 will no longer turn relative to the threaded portion 160, but will engage the threaded portion 160 to transfer torque from the drive member 110 through the core member 150 to the jacket 170, and thereby also to the driven member 130. Accordingly, the torque transfer assembly operates to distribute forces through the components of the bit holder 100 to prevent damage. The threaded portion 160 of the core member 150 and the threads 220 of the threaded nut 200 (or more generally the threaded nut 220) may be considered to be a multi-start thread assembly configured to transfer torque between the drive end 110 and the driven end 130 (via engagement with the jacket 170). Thus, the multi-start thread assembly may operably couple the torque transfer assembly to the core member 150.

Accordingly, driving device (e.g., a bit holder) of an example embodiment, or a torque transfer assembly included in such a driving device, may be provided. The impact bit holder may include a drive body having a drive end configured to interface with a powered driver, a driven body having a driven end configured to interface with a bit, and a torque transfer assembly. The torque transfer assembly may be disposed between the drive body and driven body and configured to transfer torque between the drive body and the driven body. The torque transfer assembly may include a jacket operably coupled to the driven body, and a multi-start thread assembly operably coupling the jacket to the drive body.

In some embodiments, the torque transfer assembly or bit holder may include additional, optional features, and/or the features described above may be modified or augmented. Some examples of modifications, optional features and augmentations are described below. It should be appreciated that the modifications, optional features and augmentations may each be added alone, or they may be added cumulatively in any desirable combination. In an example embodiment, a core member of the bit holder may be operably coupled to the drive body, and the multi-start thread assembly may include a threaded portion of the core member and a threaded nut having multi-start threads configured to engage corresponding multi-start threads of the threaded portion. In an example embodiment, the core member may be operably coupled to the drive body via a hex shaped protrusion defining a drive body interface at the core member that is configured to friction fit with a hex shaped reception cavity of the drive body. In some cases, the core member may include a rod having a front end. The rod may have a transition region disposed between the front end and the threaded portion at which a diameter of the rod increases from a first diameter at the front end to a second diameter proximate to the threaded portion. In an example embodiment, the driven member may include a coupling member configured to extend around a periphery of the front end of the rod, and the jacket may be affixed to the coupling member. In some cases, the torque transfer assembly may further include a hammer head disposed on the rod proximate to the transition region, and the hammer head may be configured to translate linearly toward the driven end responsive to rotation of the threaded nut relative to the threaded portion. In an example embodiment, the torque transfer assembly may further include a first impact energy absorbing washer disposed between the coupling member and the hammer head and, in response to the hammer head impacting the first impact energy absorbing washer, torque may be transferred through the multi-start thread assembly from the drive end to the driven end via the core member and the jacket. In some cases, a first bushing may be disposed between the coupling member and the front end of the rod, and the hammer head may include an extension portion. The first bushing and the first impact energy absorbing washer may be configured to extend around an outer periphery of the extension portion. In an example embodiment, the torque transfer assembly may further include a second impact energy absorbing washer disposed between the hammer head and the threaded nut. In some cases, a second bushing may be disposed between the rod and the jacket at a portion of the rod that is opposite the transition region with respect to the threaded portion.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An impact bit holder comprising:

a drive body having a drive end configured to interface with a powered driver;

a driven body having a driven end configured to interface with a bit; and a torque transfer assembly disposed between the drive body and driven body and configured to transfer torque between the drive body and the driven body;

wherein the torque transfer assembly comprises a jacket operably coupled to the driven body, and a multi-start thread assembly operably coupling the jacket to the drive body.

2. The impact bit holder of claim 1, further comprising a core member operably coupled to the drive body, wherein the multi-start thread assembly comprises a threaded portion of the core member and a threaded nut having multi-start threads configured to engage corresponding multi-start threads of the threaded portion.

3. The impact bit holder of claim 2, wherein the core member is operably coupled to the drive body via a hex shaped protrusion defining a drive body interface at the core member that is configured to friction fit with a hex shaped reception cavity of the drive body.

4. The impact bit holder of claim 2, wherein the core member comprises a rod having a front end, wherein the rod has a transition region disposed between the front end and the threaded portion at which a diameter of the rod increases from a first diameter at the front end to a second diameter proximate to the threaded portion.

5. The impact bit holder of claim 4, wherein the driven member comprises a coupling member configured to extend around a periphery of the front end of the rod, and wherein the jacket is affixed to the coupling member.

6. The impact bit holder of claim 5, wherein the torque transfer assembly further comprises a hammer head disposed on the rod proximate to the transition region, and wherein the hammer head is configured to translate linearly toward the driven end responsive to rotation of the threaded nut relative to the threaded portion.

7. The impact bit holder of claim 6, wherein the torque transfer assembly further comprises a first impact energy absorbing washer disposed between the coupling member and the hammer head, and wherein in response to the hammer head impacting the first impact energy absorbing washer, torque is transferred through the multi-start thread assembly from the drive end to the driven end via the core member and the jacket.

8. The impact bit holder of claim 7, wherein a first bushing is disposed between the coupling member and the front end of the rod, and wherein the hammer head comprises an extension portion, the first bushing and the first impact energy absorbing washer being configured to extend around an outer periphery of the extension portion.

9. The impact bit holder of claim 7, wherein the torque transfer assembly further comprises a second impact energy absorbing washer disposed between the hammer head and the threaded nut.

10. The impact bit holder of claim 7, wherein a second bushing is disposed between the rod and the jacket at a portion of the rod that is opposite the transition region with respect to the threaded portion.

11. A torque transfer assembly for an impact bit holder, the torque transfer assembly comprising:

a jacket operably coupled to a driven body having a driven end configured to interface with a bit, and a multi-start thread assembly operably coupling the jacket to a drive body having a drive end configured to interface with a powered driver, wherein the torque transfer assembly is disposed between the drive body and driven body and configured to transfer torque between the drive body and the driven body.

12. The torque transfer assembly of claim 11, wherein a core member of the bit holder is operably coupled to the drive body, and wherein the multi-start thread assembly comprises a threaded portion of the core member and a threaded nut having multi-start threads configured to engage corresponding multi-start threads of the threaded portion.

13. The torque transfer assembly of claim 12, wherein the core member is operably coupled to the drive body via a hex shaped protrusion defining a drive body interface at the core member that is configured to friction fit with a hex shaped reception cavity of the drive body.

14. The torque transfer assembly of claim 13, wherein the core member comprises a rod having a front end, wherein the rod has a transition region disposed between the front end and the threaded portion at which a diameter of the rod increases from a first diameter at the front end to a second diameter proximate to the threaded portion.

15. The torque transfer assembly of claim 14, wherein the driven member comprises a coupling member configured to extend around a periphery of the front end of the rod, and wherein the jacket is affixed to the coupling member.

16. The torque transfer assembly of claim 15, wherein the torque transfer assembly further comprises a hammer head disposed on the rod proximate to the transition region, and wherein the hammer head is configured to translate linearly toward the driven end responsive to rotation of the threaded nut relative to the threaded portion.

17. The torque transfer assembly of claim 16, wherein the torque transfer assembly further comprises a first impact energy absorbing washer disposed between the coupling member and the hammer head, and wherein in response to the hammer head impacting the first impact energy absorbing washer, torque is transferred through the multi-start thread assembly from the drive end to the driven end via the core member and the jacket.

18. The torque transfer assembly of claim 17, wherein a first bushing is disposed between the coupling member and the front end of the rod, and wherein the hammer head comprises an extension portion, the first bushing and the first impact energy absorbing washer being configured to extend around an outer periphery of the extension portion.

19. The torque transfer assembly of claim 17, wherein the torque transfer assembly further comprises a second impact energy absorbing washer disposed between the hammer head and the threaded nut.

20. The torque transfer assembly of claim 17, wherein a second bushing is disposed between the rod and the jacket at a portion of the rod that is opposite the transition region with respect to the threaded portion.

* * * * *